United States Patent [19]

Bennett

[11] 4,038,719

[45] Aug. 2, 1977

[54] HANDLE FOR TOOLS AND SPORTING EQUIPMENT

[76] Inventor: John F. Bennett, 600 Fondulac Drive, East Peoria, Ill. 61611

[21] Appl. No.: 619,201

[22] Filed: Oct. 3, 1975

Related U.S. Application Data

[63] Continuation-in-part of Ser. No. 400,172, Sept. 24, 1973, abandoned.

[51] Int. Cl.[2] ..... B25G 1/10

[52] U.S. Cl. ..... 16/110 R; 273/81.3; 145/61 L

[58] Field of Search ..... 145/61 L, 61 C, 61 R; 16/110 R; 273/81.3, 81 B, 67 DA; 15/143 R

[56] References Cited

U.S. PATENT DOCUMENTS

| | | | |
|---|---|---|---|
| 42,220 | 4/1864 | Olmsted | 16/110 R |
| 684,098 | 10/1901 | Regan | 145/61 R |
| 1,418,683 | 6/1922 | Stevens | 145/61 C |
| 1,470,040 | 10/1923 | Whitehead | 145/61 R |
| 2,421,339 | 5/1947 | Leger | 30/340 X |
| 2,712,765 | 7/1955 | Knight, Jr. | 145/61 R |
| 3,080,900 | 3/1963 | Rosenberg | 145/61 R X |
| 3,122,774 | 3/1964 | Lamb | 16/110 R |
| D. 104,484 | 5/1937 | Weinig | 145/61 C |

*Primary Examiner*—Andrew V. Kundrat
*Attorney, Agent, or Firm*—Amster & Rothstein

[57] ABSTRACT

Disclosed herein is a handle for tools and sporting equipment which reduces fatigue and tension. The handle comprises an elongated member equipped with a grip at one end which is disposed at an angle from the longitudinal axis of the elongated member corresponding to the natural angle of the hand and wrist in a gripping position. The handle has a cross-section of generally oval shape corresponding to the shape of the opening between the palm and the fingers when the hand is closed, and is perferably slightly tapered.

3 Claims, 9 Drawing Figures

HANDLE FOR TOOLS AND SPORTING EQUIPMENT

This application is a Continuation - in - Part of Application Ser. No. 400,172, filed Sept. 24, 1973 and now abandoned.

The present invention relates to handles and more particularly to handles for tools and sporting equipment.

Conventional handles for brooms, mops, rakes and similar implements have been made of wood. These wooden handles or "broomsticks" have been imported from Malaysia where the thin straight wood was plentiful. Recently, as the trees from which these handles are made are becoming scarcer there has been a shortage of straight wooden handles. As a result, other materials have been considered for handles such as aluminum, in an attempt to meet the demand for rugged, lightweight handles. Handle material must meet several criteria: economy of cost, lightness of weight, and reasonable gripability. When aluminum is used as a handle the material must be tubular to save weight and must therefore be capped at one end. In addition, the outer surface must be knurled or similarly treated to provide a gripping surface.

A major disadvantage of conventional handles, however, is the fact that such handles retain the original straight configuration. In order to use an implement with a conventional handle the user must rotate his wrist to the full extent of its travel, wasting muscular energy to maintain the wrist in this position. Thus conventional handles are actually fatiguing, requiring man to adapt to the configuration of the handle. In addition, such conventional handles waste energy as it is very difficult to assure that muscular energy is not wasted in keeping the handle from rotating about the implement since the user's forearm is not pushing along the axis of the conventional handle.

The handle of this invention is specifically designed to utilize the natural angle between the gripping portion of the hand and the axis of the forearm. In a relaxed position, the center line of the natural grip line of the hand is angularly disposed to the axis of the forearm. A handle, having gripping portion disposed at the corresponding angle, enables the user to grasp the handle so that the axis of the straight portion of the handle is nearly coaxial with the axis of the forearm. This relationship between the straight portion of the handle and the user's forearm is obtained without the user having to rotate his wrist out of its relaxed position since the gripping portion is angularly disposed in such manner as to be substantially parallel to the center line of the grip line of the hand when the wrist is in its relaxed position. Consequently, the user is able to grip the implement by the handle with his wrist in a relaxed position so that no muscular energy is expended when the handle is gripped.

Further, since the user's forearm and the straight portion of the handle are substantially coaxial all of the fore and aft motion of the user's arm is translated directly into the implement. No energy is lost by the creation of rotational forces about the handle since the muscular energy is put into the implement by the user's forearm acting coaxially with the straight handle portion.

Since natural broomstick materials are not as readily available for use as handles when substitute materials ae utilized there is no need to remain constrained to the straight configuration of conventional handles, occuring in nature. As was recognized in the sciences of human engineering and anthropometry, if tools are adapted to the human body, such tools can be used more efficiently. For example, a handle that can be more comfortably gripped by the hand requires less muscular force to use and can be used for a longer period of time before fatigue sets in. Similarly, properly designed tools take advantage of the fact that certain muscles are more particularly suited to pulling, pushing or turning. The handles on such tools should be properly shaped so there will be more efficient transfer of energy from the body to the implement. Proper design will enable the user to exert stronger forces with more control and with less fatigue.

Many treatises have been prepared and studies performed to determine the limit of travel of the various human appendages, the optimum forces exertable in the various directions and modes, the degree of exertion for the respective motions, and the optimum directions for control and/or force.

The handle of this invention incorporates these teachings of human engineers and anthropometrists in adapting the traditional concept of a handle to produce a handle that is adapted specifically to the shape of man to take full advantage of motion that is most natural, efficient and comfortable for humans. As a result the handle of this invention will reduce user fatigue and increase available force and control. Consequently, it is an objective of this invention to produce a handle for tools and sporting equipment that is specifically designed to be compatible with the shape, size, and configuration of the hand and arm.

It is a further objective of this invention to provide a handle that conserves the muscular energy of its user.

It is a yet further objective of this invention to provide a handle that maximizes the muscular output of the human arm by minimizing the loss of energy between the user's arm and the handle of the tool.

It is a still further objective of this invention to provide a handle having these and other advantages in a configuration that is economical to manufacture, that utilizes readily available materials, and is light in weight.

These and other advantages of Applicant's invention will be apparent from a review of the drawings wherein.

Figure 7:
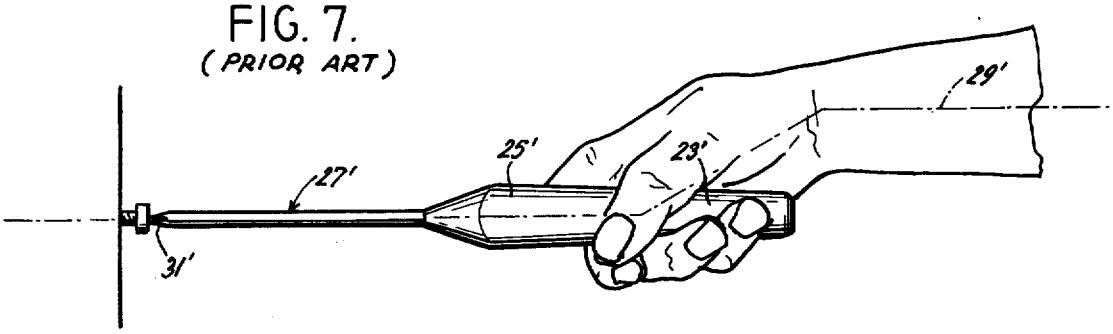
FIG. 7. (PRIOR ART)

FIG. 7 contrasts the wrist position of a user of a screwdriver having a conventional handle.

Figure 8:
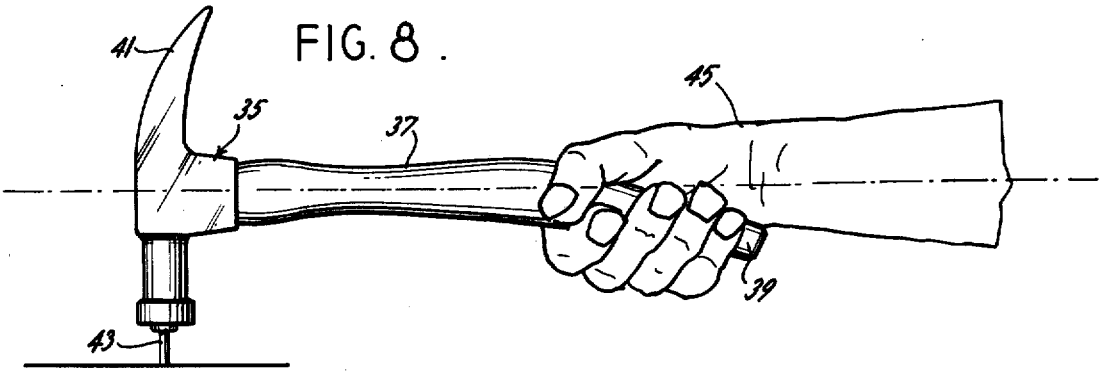

FIG. 8 shows the wrist position of the user of an otherwise conventional hammer having the handle of this invention.

Figure 9:
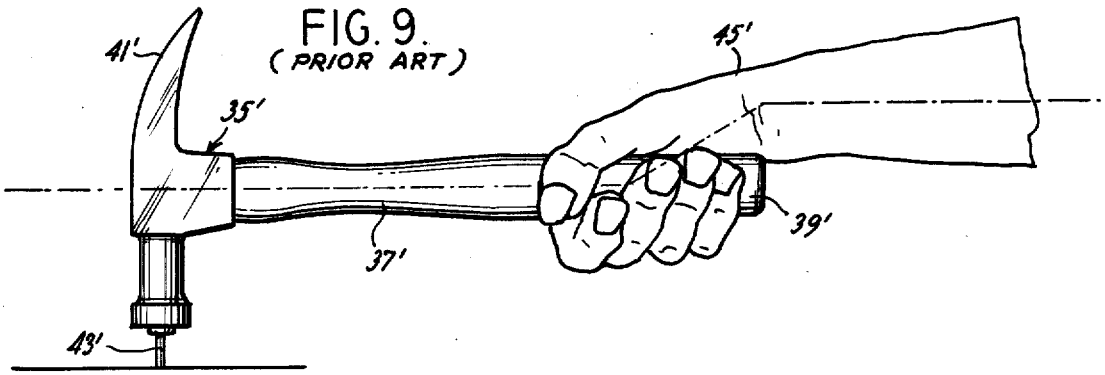
FIG. 9. (PRIOR ART)

FIG. 9 contrasts the wrist position of a user of a conventional handle. The handle of this invention is useful in tools such as wheelbarrows, hammers, mops, rakes, hoes, shovels, brooms, dust mops, screwsrivers, axes, and can also be used for sporting equipment such as golf clubs and ball bats. If the implement is to be pushed, the handle is fashioned so that the gripping portion curves downward. If the implement or club is to be swung or pulled the handle is generally used with the curve away from the body.

Figure 1:
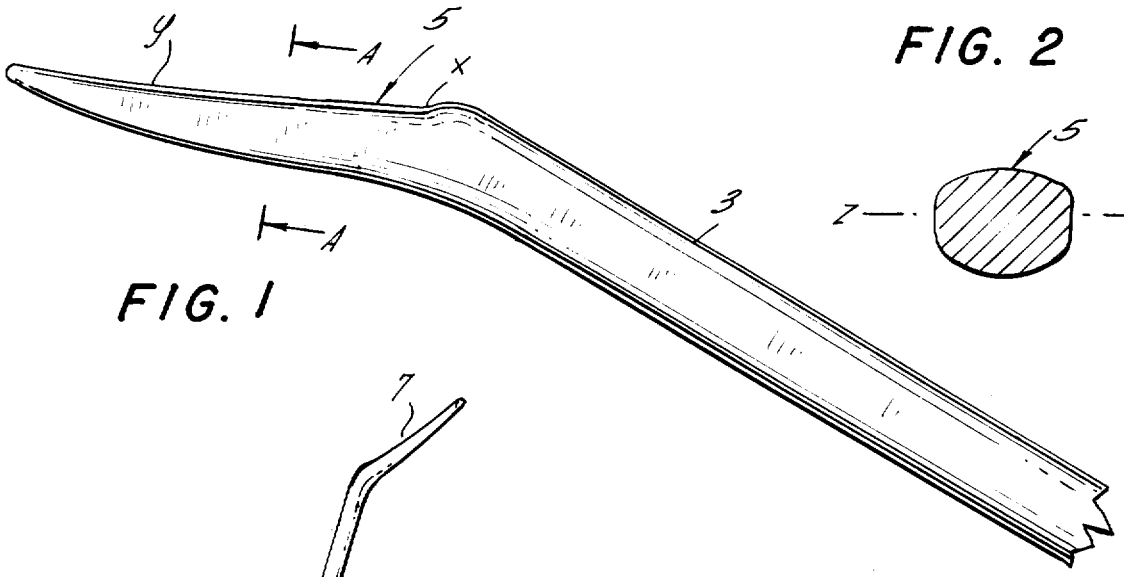
FIG. 1 is the side view showing the relationship between the grip and the elongated portion of the handle.

The handle comprises a straight, elongated member and a gripping portion, located at one end of the elongated member. The gripping portion is disposed at an angle of approximately 15°-25° to the longitudinal axis of the straight, elongated member. The angle between the straight member and the gripping portion corresponds to the angle of wrist flexion and extension. When the forearm is substantially horizontal, and the wrist joint in a relaxed position, the axis corresponding to the most comfortable grip for for-and-aft thrusting motion is also substantially horizontal. When a conventional broom handle, however, is utilized the axis of the handle intersects the user's hand at a downward angle. Applicant's handle, however, has a gripping portion disposed from the straight, elongated member of the handle, as shown in FIG. 1 whereby the gripping portion is substantially horizontal when a broom or similar implement is used in the conventional manner. This substantially horizontal disposition enables the user to grip the handle with his wrist in its relaxed position while the gripping portion of the handle is disposed along the natural grip line of the user's hand.

The grip of Applicant's handle has an essentially oval cross-section and is preferably slightly tapered. The oval cross-section more closely corresponds to the natural shape of the opening created in the hand when a generally cylindrical object is gripped. Further, the tapered configuration of the handle again more closely simulates the decreasing circumference of the natural opening in a hand when a gripping configuration is assumed.

A more detailed understanding of the invention can be obtained by referring to the accompanying drawings. FIG. 1 shows an elongated member 3 having a grip 5 located at one end. The elongated member 3 may be the conventional handle used on brooms, wheelbarrows, or the like or may be a handle used on a golf club or ball bat if, for example, this invention is applied to sporting equipment. Thus the elongated member 3 may be made of plastic, metal or wood; it may be solid or hollow.

When made of metal it is best to construct the elongated member 3 of hollow material to reduce the weight of the overall handle. Further, in order to most economically produce the configuration of the grip 5 it may be advantageous to separately mold the grip 5 from such material as a plastic and press fit the molded grip 5 to a hollow elongated member 3. In such manner, the hollow metal elongated member 3 need not be specially treated, i.e., knurled to increase its gripping properties, as the grip 5 made of plastic is readily grippable, and serves the additional function of capping the hollow elongated member 3.

The longitudinal axis of the grip 5 is at an angle of approximately 15°-25° to the longitudinal axis of the elongated member 3. As described above, this angle is chosen to comfortably engage the user's hand when the invention is fitted in a conventional broom or similar implement.

Figure 2:
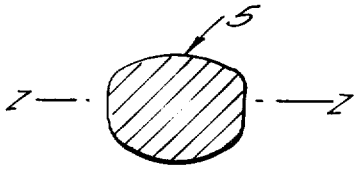
FIG. 2 is a cross-sectional view of the grip along plane A-A.

The shape of the grip is illustrated in FIG. 2 which shows a cross-sectional view looking at plane A-13 A. The grip should have an essentially oval cross-section. The oval cross-section was found to make the grip 5 more comfortably conform to the oval between the thumb and the index finger.

Although the essential shape of the cross-section of the handle should be oval it has been discovered that the performance is improved by slightly flattening the top of the oval to provide a flat side at the user's side.

It has also been discovered that the performance can be improved by slightly tapering the handle so that the circumference of the oval cross-section diminishes along the longitudinal axis of the grip away from the elongated member 3. This reduction in circumference again corresponds to the shape of a user's hand. When the hand is in the gripping configuration the oval shape formed in the hand is decreasing in circumference.

The size of the elongated member and the grip may vary greatly from application to application. However, for a typical application for a pushbroom, the circumference of the elongated member 3 may be approximately 3 ½ inches, the circumference of the grip at point X may be 3 ½ inches, and the circumference may be as small as 2 ½ inches at point Y, which is 2 ½ inches away from point X along the longitudinal axis of the grip. It is thus seen in the example given that the taper is slight. In general, the circumference of the grip will diminish at a rate of from 0.3 to 0.6 inches of circumference per inch of longitudinal axis of the grip.

Figure 3:
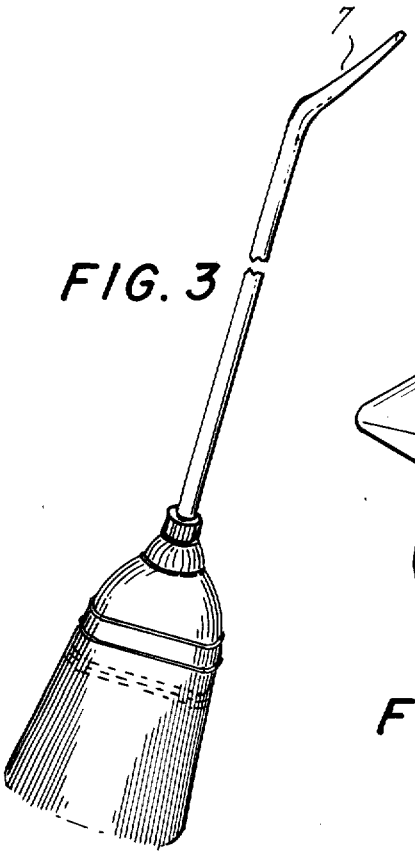
FIG. 3 shows the handle on an otherwise conventional broom.

FIG. 3 illustrates the handle used on an otherwise conventional broom. The elongated member and broomhead are conventional, except that the elongated member is equipped with a grip 7 at an angle of approximately 19° from the longitudinal axis of the elongated member or conventional broom handle. The handle is placed so that the grip curves toward one side of the broomhead and is used by grasping the grip so that the curve is away from the body. It has been found that this reduces the pressure on chest muscles and is generally less fatiguing than using a conventional broom.

Figure 4:
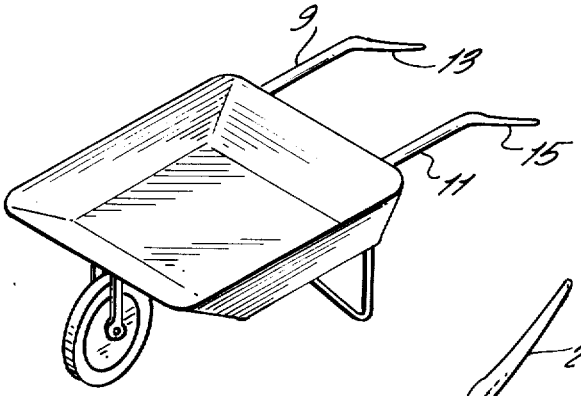
FIG. 4 illustrates the use of a handle on an otherwise conventional wheelbarrow.

FIG. 4 illustrates the use of this invention on a wheelbarrow. The elongated members 9 and 11 may be the conventional handles of an ordinary wheelbarrow with the exception that they are equipped with handles 13 and 15 of this invention. Note that the handles are placed so that the ends of the grips point down toward the earth. The angle between the grips 13 and 15 and the elongated members 9 and 11 should, as discussed above, be within the range of from 15°-25°, preferably 18°-20°.

Figure 5:
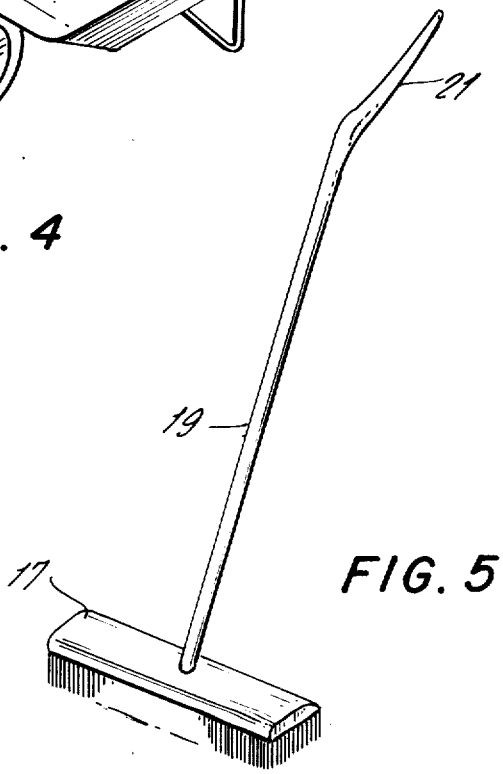
FIG. 5 illustrates the use of a handle for an otherwise conventional push broom.

FIG. 5 shows the use of the handle of this invention on a conventional pushbroom. As is illustrated, the handles may be used with the conventional broomhead 17. The elongated member 19 shown is conventional except that it is equipped with a handle of this invention 21 wherein the grip is at an angle of approximately 19° to the longitudinal axis of the elongated member 19.

Figure 6:
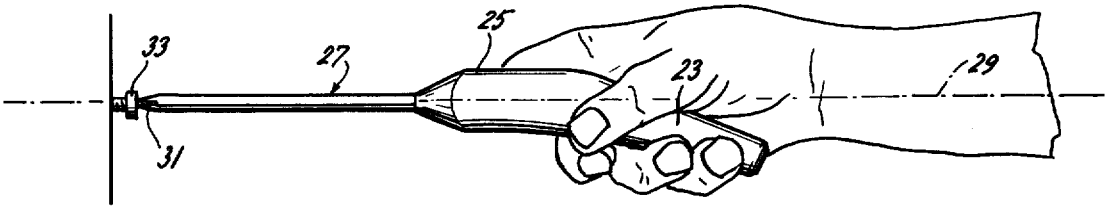
FIG. 6 shows the wrist position of the user of an otherwise conventional screwdriver containing the handle of this invention.

To more clearly show the utilization of this invention FIGS. 6 and 7 contrast the wrist and forearm position of the user when this handle and a conventional handle are used on a screwdriver. As shown in FIG. 6, the gripping portion 23 is angularly disposed at an angle of approximately 15°-25° from the straight portion 25 of the handle on the modified screwdriver 27. As shown by the dotted line, when the screwdriver 27 is held by the user the axis 29 of the forearm is substantially coaxial to the axis of the screwdriver 27. Consequently, when the forearm exerts a thrusting motion, necessary to keep the tip 31 of the screwdriver 27 engaged in the screwhead 33 the thrusting force is directly transferred the tip 31 of the screwdriver 27.

In addition to the conservation of thrust by this handle, it also provides a more comfortable grip for the screwdriver. The user's wrist is in a relaxed position intermediate its full flexion and extension positions.

FIG. 7 shows the conventional screwdriver 27' utilized in a similar manner. The gripping portion 23' of the screwdriver 27' is coaxial with the axis of the straight portion 25'. The axis 29' of the user's forearm, although it is parallel to the axis of the screwdriver 27', is not coaxial. Consequently, when the user exerts a thrusting force on the conventional screwdriver 27' to assure that the tip 31' remains engaged with screwhead 33' a rotational moment is set up about the screwdriver 27'. As a result, the user must exert additional energy to prevent the conventional screwdriver 27' from becoming disengaged with the screwhead 33' as the result of this rotational moment. Such additional force increases the likelihood of fatigue of the user and decreases the force available for holding the tip 31' in the screwhead 33'. In addition, there is less force available to rotate the screwdriver 27'.

As shown in FIG. 8 the Applicant's invention is also useful for striking tools such as a hammer. The hammer 35 in FIG. 8 contains a handle having a straight portion 37 and a gripping portion 39. Again, the gripping portion 39 is angularly disposed from the axis of the straight portion 37 at an angle of approximately 15°-25°. Unlike in the screwdriver application of significance of the angular disposition of the handle is the resultant position of the wrist at the momemt of impact of the hammerhead 41 and the nail 43. As shown in FIG. 8 the user's wrist 45 is in a relaxed position, intermediate of its flexion and extension. Consequently, when the hammer jars as a result of the hammerhead 41 striking the nail 43, the shock and vibration from the impact which is transmitted along the handle of the hammer is dissipated in the relaxed wrist joint.

When the conventional hammer 35' is used as shown in FIG. 9 the gripping portion 39' is coaxial to the straight portion 37'. Consequently, at the instant the hammerhead 41' impacts with the nail 43', the user's wrist 45' is at the limit of the extension of its travel. In such orientation, the wrist joint is rigidly locked, which allows the shock and vibration from the impact to be translated from the handle through the locked wrist joint to the user's forearm and elbow joint. This transmission of shock and vibration to the user's elbow can cause a condition known as "tennis elbow".

Specifically, when the handle of this invention is used with implements that are pushed or pulled the handle provides a more tension free position between the user's hand and the implement thereby enabling the user to impart more power into the implement while also maintaining better control. The angularly disposed gripping point portion of this handle allows the arm and shoulder muscles to contribute to the work force with the wrist joint being held in a position to allow the force of the forearm to be transmitted coaxially into the implement so there is efficient transfer of energy. The user's wrist can be placed in a relaxed, straight position, which is comfortable and tension free, consuming less muscular power. Since the human wrist is a joint with multiple degrees of freedom it is, in effect, a natural universal joint. As a universal joint bends, the joint is subject to complex loading. A tensile or compressive load on a bent universal joint sets up a bending moment coupled with the tensile or compressive force, creating a wobbling action. The human wrist is loaded in a similar manner when a conventional handle is used and is thus in an unstable condition requiring the muscles of the wrist joint to consume power to oppose the bending moment. The constant muscular contraction required contributes to fatigue of the user. When the handle of this invention is used the wrist joint is able to be held in a straight position with a relatively tension free grip. Consequently, there is no bending moment around the wrists since the tensile or compressive forces pass from the axis of the forearm to the axis of the straight portion of the handle through the wrist joint itself. There is no rotational force or moment created about the user's wrist and the grip is essentially tension free.

The angularly disposed gripping portion also contributes to the increased rotational force that can be applied to an implement. A screwdriver, as shown in FIG. 6, can be used to apply a greater torque since the rotational force imparted by the user's hand is acting through a longer moment arm then in the conventional, straight handled screwdriver as shown in FIG. 7. This increased torque is also useful for large dust mops of the type used for cleaning basketball courts and similar floors. The wide dust mop implement is mounted to a handle through a pivotal mounting point whereby the dust mop can be steered by the turning motion of the handle. The angularly disposed gripping portion enables the user to apply a greater turning force to more easily steer the dust mop.

Further, the oval shape of the gripping portion which is greater in its width than its length to more exactly confirm to the oval of the user's hand when in the gripping position, is particularly useful for users having long fingernails. The increased diameter of the gripping portion of the handle of this invention prevents longer fingernails from pushing against the palms of the hand as might occur with conventional handles.

It has been found that the handle of this invention provides a more tension-free position to develop the proper pushing, lifting or pulling force. The angle and basic design of this handle will reduce the fatigue of the operator. It can be applied on all tools or sporting equipment whether it be as a broom handle to push or pull, on a hoe or rake in pulling, on a wheelbarrow or shovel in lifting and pushing, or in swinging or casting. This design lessens fatigue and increases productivity.

A latitude of modification, change and substitution is intended in the foregoing disclosure. Accordingly, it is appropriate that the appended claims be construed broadly and in the manner consistent with the spirit and scope of the invention.

What is claimed is:

1. A handle for implements such as tools and sporting equipment adapted to be held by a hand and moved by at least a forearm of a user comprising a gripping portion, means adapted to connect said gripping portion to an elongated member so that when said gripping portion is held by said user said elongated member is intermediate said gripping portion and said implement, the longitudinal axis of said elongated member being substantially coaxial to the longitudinal axis of said implement whereby rotation of said longitudinal axis of said forearm of said user causes substantially coaxial rotation of said elongated member of said implement about said longitudinal axes, said elongated member is intermediate said gripping portion and said implement, and means being constructed arranged whereby said gripping portion is angularly disposed from said elongated member so that when placed in the hand of said user the longitudinal axis of said elongated member is substantially coaxial to the longitudinal axis of said forearm of said user, and wherein said gripping portion has a substantially oval cross-section, said oval cross-section decreasing in circumference as the distance from said connecting means increases, and said substantially oval cross-section has substantially flattened end surfaces traverse to the long axis of the oval.

2. A handle as recited in claim 1 wherein said angular disposition is from 15°–25°.

3. A handle for implements such as tools and sporting equipment adapted to be held in a hand and moved by at least a forearm of user comprising an elongated member and an angularly disposed gripping portion at one end of said elongated member, said gripping portion having a substantially oval cross-section, said oval cross-section decreasing in circumference as the distance from and said elongated member increases, said substantially oval cross-section having a substantially flattened end surfaces transverse to the long axis of the oval, said angular disposition of said gripping portion at an angle of from 15°–25° from said elongated member such that said gripping portion is adapted to be engaged by said hand of said user so that the longitudinal axis of said elongated member is substantially coaxial to the longitudinal axis of said forearm of said user.

* * * * *